United States Patent [19]

Bingham

[11] 4,424,923

[45] Jan. 10, 1984

[54] BATON AND CLUB SECURING DEVICE

[76] Inventor: Dennis M. Bingham, 105 W. 700 North, Bountiful, Utah 84010

[21] Appl. No.: 426,267

[22] Filed: Sep. 29, 1982

[51] Int. Cl.[3] ..... F41B 15/02

[52] U.S. Cl. ..... 224/251; 224/914; 273/84 R

[58] Field of Search ..... 224/251, 242, 245, 255, 224/914, 915, 197; 273/84 R

[56] References Cited

U.S. PATENT DOCUMENTS

| | | | |
|---|---|---|---|
| 2,455,765 | 12/1948 | Harvey | 224/255 |
| 2,527,710 | 10/1950 | Davidson, Jr. | 224/242 X |
| 3,307,754 | 3/1967 | Anketell | 224/197 |
| 4,355,804 | 10/1982 | Bingham | 224/914 X |

*Primary Examiner*—Steven M. Pollard

*Attorney, Agent, or Firm*—Thorpe, North & Western

[57] ABSTRACT

A device for detachably securing a baton or the like in a carrying ring through which the baton may be slidably inserted. The device includes a base section by which the device is attached to the sides of the baton. This section could be in the form of an annulus into which the baton was inserted, or a generally flat tab for attachment to the side of the baton. The base section includes an enlarged portion for contacting the ring when the baton is inserted through the ring to thus support the base section and baton and prevent the baton from sliding downwardly all the way through the ring. The device also includes a lever, the lower end of which is formed into a hook and the upper end of which serves as a trigger. The lever is fixed to the base section so that the hook is normally biased to a first position where the hook will engage the ring and prevent removal of the baton from the ring when the baton is lifted. When the trigger is depressed, the hook is moved to a second position where the hook will not engage the ring when the baton is lifted.

18 Claims, 6 Drawing Figures

BATON AND CLUB SECURING DEVICE

BACKGROUND OF THE INVENTION

This invention relates to a device for holding a club or baton of the type carried by police officers and the like, and more particularly to a device for both allowing the club or baton to be held in a conventional ring in a locked condition, and yet allowing release of the club or baton when properly manipulated.

Police batons, sometimes called nightsticks, police clubs, etc., have been employed by law enforcement agencies for years for use in non-lethal control of people and for defense. Examples are shown in U.S. Pat. Nos. 27,335; 3,307,754; and 3,944,226. Such batons are formed of elongated sticks which have a generally circular cross-section. Batons of this type are typically carried in a ring which is attached to the officer's trousers or belt. In order to facilitate this, the batons are provided with a protruding shoulder portion at the base of the handle of the baton so that when the baton is inserted into the ring, the shoulder will contact the ring and prevent the baton from sliding therethrough.

The above-described baton and carrying ring provide a simple and easy-to-use weapon for the police officer, but it also presents some problems and dangers to the officer. For example, the baton may easily slide out of the ring if jarred or otherwise toppled and to prevent this, the officer must spend some of his time simply stabilizing or holding the baton in his hand in order to prevent its loss. Furthermore, because of the ease of removal of the club from the ring, anyone, including an assailant, may remove the baton from the ring while the officer is occupied in other matters where his attention is not directed to maintaining the baton in the holder. It has been known for assailants to remove an officer's baton and then assault the officer with the baton.

Although various arrangements may be devised for simply securing the baton in the ring, this would not meet the needs of the officer in carrying a weapon which can be rapidly put into use by quick and easy removal of the baton from the ring.

SUMMARY OF THE INVENTION

It is an object of the invention to provide a device for holding a police baton or the like in a carrying ring while also allowing quick removal of the baton from the ring.

It is another object of this invention to provide such a device which may be easily mounted on the baton with no or very little modification to the baton.

It is a further object of the invention to provide such a device which allows for easy removal of the baton from a ring holder by merely grasping a release mechanism as the club is withdrawn.

It is an additional object of the invention to provide such a device which, when mounted on a baton, does not interfere with the insertion of the baton into its holder while at the same time automatically securing the baton in the holder once it is inserted therein.

It is a further object of the invention to provide such a device which is simple in construction and is easy to manufacture.

The above and other objects of the invention are realized in an illustrative embodiment of a device for detachably securing a baton or the like in a carrying ring through which the baton may be slidably inserted. The device includes a base section attachable to the sides of the baton, with the base section including an enlarged portion for contacting the ring when the baton is inserted through the ring to thereby support the base section and baton and prevent the baton from passing through the ring. Also included is a lever fixed to the base section and having a downwardly projecting hook element which is movable between a first position, where the hook element is disposed to engage the ring and prevent removal of the baton from the ring when the baton is lifted, and a second position where the hook element is displaced so as not to engage the ring when the baton is lifted. The lever is positioned on the device to allow easy grasping by a user to thereby cause movement of the hook element to the second position to allow removal of the baton from the ring. The lever is biased so that the hook element normally rests in the first position for preventing inadvertent loss of the baton or the intentional removal of the baton by a potential assailant of the baton owner.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
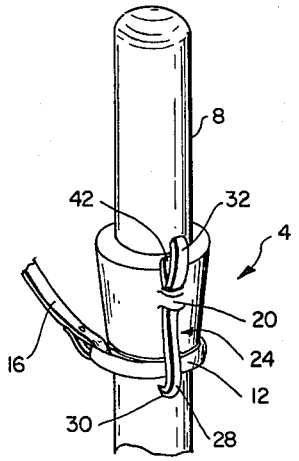
FIG. 1 shows a perspective view of a device for detachably securing a baton in a carrying ring, made in accordance with the principles of the present invention.
Figure 2:
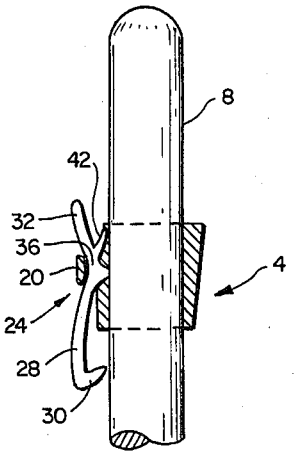
FIG. 2 is a side, elevational, partially cross-sectional view of the device of FIG. 1.

Referring to FIGS. 1 and 2 of the drawings, there is shown one embodiment of the baton securing device of the present invention which includes an annulus or grommet 4 disposed on a club or baton 8. The annulus 4 is formed of a resilient material such as neoprene rubber, polyethylene, polyvinylchloride, etc., to have an inner circumference just less than the circumference of the cross section of the baton 8. This allows the annulus to be slid over the top end of the baton 8 down to the desired position where the annulus will "grip" the baton and remain in place where positioned on the baton. That portion of the baton 8 extending above the annulus 4 would serve as the handle portion of the baton, whereas that portion extending below the annulus would serve as the club portion.

Also shown in FIG. 1 is a conventional carrying ring 12 into which the baton 8 has been inserted. The ring 12 is for attachment to the trousers or belt of a user of the baton by way of a connecting tether 16. The inner circumference of the ring 12 obviously is greater than the outer circumference of the baton 8 to allow the baton to be readily and easily inserted into the ring. The outer circumference of the annulus 4 is greater than the inner circumference of the ring 12 so that the ring will support the annulus and therefore the baton 8.

The annulus 4 includes a keeper loop 20 which is formed integrally with the annulus to extend outwardly from a first location on the side of the annulus to a second location spaced circumferentially from the first location, where the loop again joins the annulus. The keeper loop 20 defines a vertically extending space between the loop and the annulus 4.

Also included in the device of FIGS. 1 and 2 is a lever element 24 disposed in the space between the keeper loop 20 and the annulus 4. The lever element is formed of an elongate body having a downwardly extending hook portion 28 and an upwardly extending trigger portion 32. Generally centrally located in the lever element is a pivot knuckle 36 about which the lever element is adapted to pivot as will be discussed momentarily. The pivot knuckle 36 is directed inwardly toward the baton 8 to rest either against the baton through an opening in the annulus 4 or against a portion of the side wall of the annulus. Either arrangement would be suitable.

Extending toward the annulus 4 and upwardly from the trigger portion 32 near the pivot knuckle 36 is a resilient finger 42. The finger 42 rests against the exterior of the annulus 4 to bias the trigger portion 32 outwardly and thereby cause the lever element 24 to pivot about the pivot knuckle 36 and force the hook element 28 against the baton 8 as shown in FIG. 2. Of course, other types of spring or biasing elements could also be used such as coil springs, metallic leaf springs, etc. This position is the "lock" position wherein if the baton 8 is lifted upwardly, the hook portion 28 will engage the ring 12 to prevent removal of the baton from the ring. In order to release the baton for removal from the ring, the trigger portion 32 must be pressed inwardly toward the baton to cause the lever element 24 to pivot about the pivot knuckle 36 and cause the hook portion 28 to move outwardly away from the baton 8. With the hook portion 28 pivoted away from the baton 8, the baton may be lifted from the ring with the hook portion not engaging the ring to allow complete removal of the baton.

The hook portion 28 is formed to allow the hook portion to pivot outwardly and slide over the ring as the baton 8 is being inserted into the ring. More specifically, the hook portion 28 inludes an inwardly and upwardly directed end 30 which, when contacted by the ring 12, will tend to force the hook portion 28 outwardly to allow the baton to slide through the ring until the ring is contacted by the annulus 4. After the hooked end 30 passes over the ring, the resilient finger 42 forces the hook portion 28 into the "lock" position where the hooked end rests against the baton 8.

Advantageously, the lever element 24 is integrally formed of polyethylene, resilient metal or metal alloy, etc. The lever element 24 and annulus 4 are assembled by simply inserting the lever element into the space between the keeper loop 20 and the annulus until the pivot knuckle 36 is adjacent either to the opening in the annulus or that part of the annulus against which it will pivot.

Figure 3:
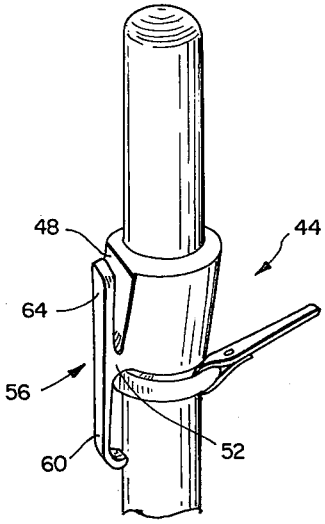
FIG. 3 is a perspective view of another embodiment of the device of the present invention.
Figure 4:
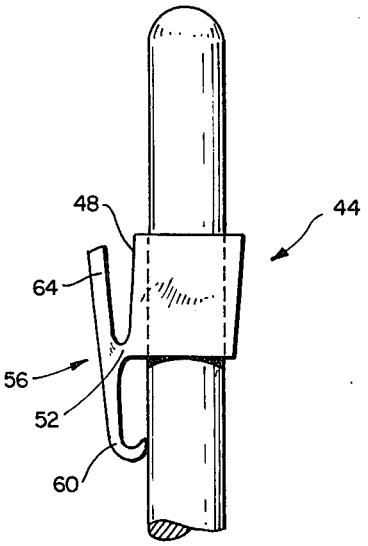
FIG. 4 is a side, elevational view of the device of FIG. 3.

FIGS. 3 and 4 show another embodiment of the baton securing device of the present invention. In this embodiment, the device is formed of a single integral piece of material to include an annulus portion 44. Again, the annulus portion 44 is formed with an inner circumference which is just less than the cross-sectional circumference of the baton on which it would be mounted, and with an outer circumference greater than the inner circumference of the ring into which the baton will be inserted. One side of the annulus portion 44 is formed to define a generally flat surface 48. Joined to the annulus portion at a location below the flat surface 48 by a connecting pivot bridge 52 is a lever element 56. The lever element 56 is connected near its midpoint to the pivot bridge 52 as shown in the drawings. The lever element 56 comprises an elongate body with a downwardly extending hook portion 60 and an upwardly extending trigger portion 64.

The annulus 44, pivot bridge 52 and lever element 56 are formed of resilient material such as neoprene rubber, polyethylene, etc., which serves to normally bias the lever element 56 so that the trigger portion 64 is spaced from the flat surface 48 and the hook portion 60 is in contact with the baton on which the device is mounted. This is the "lock" position, as already described for the FIGS. 1 and 2 embodiment, and in such position, a baton on which the device of FIGS. 3 and 4 is mounted cannot be removed from a carrier ring into which the baton has been inserted since the hook portion 60 will contact the ring as the baton is lifted. The baton is released simply by pressing the trigger portion 64 towards the annulus 44 to cause the hook portion 60 to pivot outwardly and away from the baton so that it will "clear" the ring as the baton is lifted.

The end of the hooked portion 60 is formed similar to the hooked end 30 of FIGS. 1 and 2 to allow the baton to be readily inserted into a carrier ring where the ring will engage and force outwardly the hooked portion 60, and then up into contact with the annulus 44.

Figure 5:
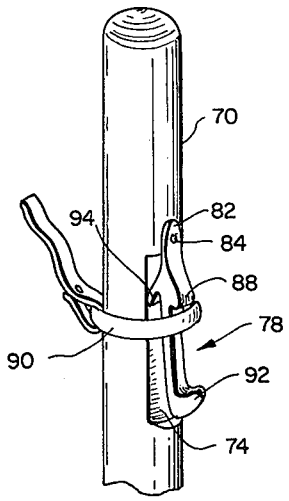
FIG. 5 is a perspective view of a third embodiment of the device of the present invention.
Figure 6:
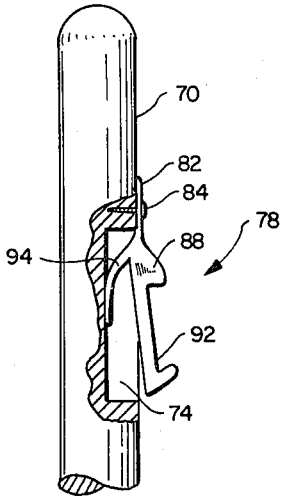
FIG. 6 is a side, elevational, partially cross-sectional view of the device of FIG. 5.

FIGS. 5 and 6 show still another embodiment of the device of the present invention. With this embodiment, a baton 70 on which the device is to be mounted is provided with an elongate slot 74 formed longitudinally in the baton.

The baton securing device of FIGS. 5 and 6 is formed of a generally elongate body 78 having an upwardly extending tab 82 which is fastened to the baton 70 by a screw 84 or other fastener at a location just above the slot 74. The body 78 also includes an enlarged portion 88 which projects outwardly from the baton 70. This enlarged portion serves both to engage a ring 90 into which the baton 70 is inserted to prevent the baton from slipping all the way through the ring, and as a trigger, to be discussed momentarily. The lower end of the body 78 is formed into a hook 92. The enlarged portion 88 and hook 92 are both disposed over the slot 74. Extending rearwardly of the body 78 and into the slot 74 into contact with the rear wall of the slot is a resilient finger 94. The body 78 is a single integral piece of material and is formed with a width which is less than the width of the slot 74 so that when the enlarged portion and trigger 88 is pressed inwardly toward the baton 70, the hook 92 is caused to move into the slot 74. Advantageously, the body 78 is made of polyethylene metal or metal alloy, etc.

When the baton 70 with the device 78 mounted thereon is inserted into the ring 90, the lower edge of the hook 92 contacts the ring 90 and the ring slides over the edge forcing the hook 92 into the slot 74. When the ring "clears" the hook 92, the resilient finger 94 forces the body 78, and in particular the hook 92, outwardly from the slot 74, and the ring next comes into contact with the enlarged portion and trigger 88. The trigger 88 prevents the baton from sliding any farther through the ring to thereby secure the baton in the carrying position in the ring. The baton 70 may be lifted upwardly and removed from the ring by simply depressing the enlarged portion and trigger 88 inwardly so that the hook 92 is caused to move into the slot 74 where it will not engage the ring. If the enlarged portion and trigger 88 is not so depressed, then any attempt to lift the baton 70 from the ring 90 will cause the hook 92 to engage the ring and prevent further lifting of the baton.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A device for detachably securing a baton or the like in a carrying ring through which the baton may be slidably inserted, said device comprising:

a base section attachable to the sides of the baton, said base section including an enlarged portion for contacting the ring when the baton is inserted through the ring to support the base section and baton and prevent the baton from passing through the ring, and lever means fixed to the base section and having a downwardly projecting hook element which is movable between a first position, wherein the hook element is disposed to engage the ring and prevent removal of the baton from the ring when the baton is lifted, and a second position, wherein the hook element is disposed so as not to engage the ring when the baton is lifted.

2. A device as in claim 1 wherein the hook element is normally biased to the first position.

3. A device as in claim 2 wherein said lever means includes a trigger element which, when depressed, causes said hook element to move to the second position.

4. A device as in claim 3 wherein the base section comprises an annulus dimensioned to fit closely about and grip the baton, and wherein the lever means is pivotally fixed to a side of the annulus.

5. A device as in claim 4 wherein the hook element forms the lower end of the lever means and the trigger element forms the upper end thereof, and wherein the lever means is fixed to the annulus to pivot about a point between the hook element and trigger element so that as the trigger element is pressed inwardly toward the baton, the hook element is caused to move outwardly to the second position.

6. A device as in claim 5 wherein the annulus is made of a resilient material and has an inner circumference which is less than the cross-sectional perimeter of the baton.

7. A device as in claim 6 wherein the base section includes a keeper loop which extends outwardly from a first location on the surface of the annulus to a second location spaced circumferentially from the first location, and wherein the lever means further includes a raised pivot knuckle between the hook element and trigger element, said lever means being disposed in the keeper loop with the hook element projecting downwardly therefrom, the trigger element projecting upwardly therefrom, and the pivot knuckle projecting inwardly of the keeper loop so that as the trigger element is pressed inwardly, the lever means pivots on the pivot knuckle causing the hook element to move outwardly.

8. A device as in claim 7 wherein said lever means further includes a resilient force means for operating against the annulus to normally bias the trigger element outwardly from the annulus and thus bias the hook element to the first position.

9. A device as in claim 8 wherein the resilient force means comprises a resilient finger formed integrally with the lever means to project toward and into contact with the annulus.

10. A device as in claim 9 wherein the lever means is made of polyethylene.

11. A device as in claim 6 further including a connecting pivot bridge joining the lever means generally at its midpoint to the annulus near the bottom thereof so that as the trigger element is pressed inwardly, the lever means pivots about the pivot bridge causing the hook element to move outwardly.

12. A device as in claim 11 wherein the connecting pivot bridge is made of resilient material to normally bias the hook element to the first position.

13. A device as in claim 12 wherein the annulus, lever means and connecting pivot bridge are all integrally formed.

14. A device as in claim 13 wherein the annulus, lever means and connecting pivot bridge are made of polyethylene.

15. A device as in claim 13 wherein the baton includes an elongate recess formed longitudinally therein, and wherein the base section comprises an upwardly extending tab by which the base section is attached to the baton at a location just above the recess, said enlarged portion and trigger element being disposed below the tab and over a portion of the recess, and wherein said hook element is joined to and extends downwardly of the enlarged portion and trigger element and over the recess so that when the trigger element is depressed the hook element is forced into the recess to the second position.

16. A device as in claim 15 wherein the base section further comprises a resilient finger extending into the recess to contact the recess bottom wall to normally bias the trigger element outwardly from the recess and thus bias the hook element to the first position.

17. A device as in claim 16 wherein the tab, enlarged portion and trigger element, hook element, and finger are all integrally formed.

18. A device as in claim 17 wherein the base section and lever means are made of polyethylene.

* * * * *